US008860639B2

(12) United States Patent
Kim et al.

(10) Patent No.: US 8,860,639 B2
(45) Date of Patent: Oct. 14, 2014

(54) TIMING CONTROLLER AND ORGANIC LIGHT EMITTING DIODE DISPLAY DEVICE USING THE SAME

(75) Inventors: Hyoung Su Kim, Paju-si (KR); Hyung Nyuck Cho, Incheon (KR)

(73) Assignee: LG Display Co., Ltd., Seoul (KR)

( * ) Notice: Subject to any disclaimer, the term of this patent is extended or adjusted under 35 U.S.C. 154(b) by 198 days.

(21) Appl. No.: 13/286,327

(22) Filed: Nov. 1, 2011

(65) Prior Publication Data

US 2012/0162159 A1 Jun. 28, 2012

(30) Foreign Application Priority Data

Dec. 22, 2010 (KR) ..... 10-2010-0132449

(51) Int. Cl.
*G09G 3/32* (2006.01)

(52) U.S. Cl.
USPC ..... 345/82; 345/99

(58) Field of Classification Search
USPC ..... 345/76–77, 82–83, 99
See application file for complete search history.

(56) References Cited

U.S. PATENT DOCUMENTS

| | | | | |
|---|---|---|---|---|
| 5,844,534 | A | 12/1998 | Okumura et al. | |
| 6,879,112 | B2 * | 4/2005 | Kubota et al. | 315/169.3 |
| 8,456,492 | B2 * | 6/2013 | Shidara et al. | 345/690 |
| 2002/0057234 | A1 * | 5/2002 | Ishizuka et al. | 345/77 |
| 2002/0196213 | A1 * | 12/2002 | Akimoto et al. | 345/82 |
| 2005/0057475 | A1 * | 3/2005 | Mamba et al. | 345/92 |
| 2006/0279489 | A1 * | 12/2006 | Ouchi et al. | 345/76 |
| 2007/0296668 | A1 | 12/2007 | Kim et al. | |
| 2008/0218448 | A1 * | 9/2008 | Park et al. | 345/76 |
| 2009/0251445 | A1 | 10/2009 | Ito et al. | |
| 2009/0267963 | A1 * | 10/2009 | Kawashima et al. | 345/690 |
| 2010/0123648 | A1 * | 5/2010 | Miller et al. | 345/76 |
| 2011/0148951 | A1 * | 6/2011 | Takeda et al. | 345/690 |

FOREIGN PATENT DOCUMENTS

CN 101551985 A 10/2009

OTHER PUBLICATIONS

Office Action dated Dec. 16, 2013, issued by the State Intellectual Property Office of China in Chinese Patent Application No. 201110378690.0.

* cited by examiner

*Primary Examiner* — Chanh Nguyen
*Assistant Examiner* — Roy Rabindranath
(74) *Attorney, Agent, or Firm* — Morgan, Lewis & Bockius LLP

(57) ABSTRACT

Disclosed are a timing controller and an OLED display device using the same. The timing controller includes a reception unit, an image signal generation unit, and a control signal generation unit. The reception unit receives a plurality of video signals and a timing signal which are transferred from a system. The image signal generation unit realigns the video signals to generate a plurality of image signals. The control signal generation unit analyzes the video signals to determine whether a current input image is a static image or a moving image, and generates a plurality of control signals according to the determined result. When the current input image is determined as the static image, the control signal generation unit generates a plurality of control signals which allow a panel to be driven at a change frame driving frequency lower than a reference frame driving frequency necessary for driving the moving image.

10 Claims, 3 Drawing Sheets

TIMING CONTROLLER AND ORGANIC LIGHT EMITTING DIODE DISPLAY DEVICE USING THE SAME

CROSS REFERENCE TO RELATED APPLICATIONS

This application claims the benefit of the Korean Patent Application No. 10-2010-0132449 filed on Dec. 22, 2010, which is hereby incorporated by reference as if fully set forth herein.

BACKGROUND

1. Field of the Invention

The present invention relates to a timing controller, and particularly, a timing controller and an Organic Light Emitting Diode (OLED) display device using the same, which reduce consumption power.

2. Discussion of the Related Art

Display devices such as LCD (Liquid Crystal Display), OLED (Organic Light Emitting Diode), PDP (Plasma Display Panel), and EPD (Electrophoretic Display) are manufactured through several steps. For manufacturing these display devices, an imprinting process using an imprinting apparatus is carried out so as to form a pattern on a substrate used for the display devices.

Flat Panel Display (FPD) devices, which decrease the weight and volume thereof corresponding to the limitations of Cathode Ray Tubes (CRTs), are being developed recently. As such FPD devices, there are Liquid Crystal Display (LCD) devices, Plasma Display Panels (PDPs), Field Emission Display (FED) devices, and electroluminescence devices.

Since PDPs are simple in structure and process, the PDPs are attracting much attention as display devices that are light, thin, short, and small, and have a large screen. However, the PDPs are low in emission efficiency, brightness, and consumption power.

Thin Film Transistor (TFT) LCD devices, using TFTs as switching elements, are FPD devices that are being widely used. However, since TFT LCD devices are non-emitting display devices, the TFT LCD devices have a narrow viewing angle and a slow response time.

On the contrary, electroluminescence devices are categorized into inorganic light emitting diode display devices and OLED display devices, based on materials of light emitting layers. Particularly, since OLED display devices use self-emitting elements that self emit light, the OLED display devices have a fast response time, high emission efficiency, high brightness, and a wide viewing angle.

FIG. 1 is a circuit diagram for describing the light emitting principle of a related art OLED display device. FIG. 2 is waveform diagrams for describing the cause of a flicker which arises in a related art LCD display device.

As a type of FPD device, an OLED display device that is as illustrated in FIG. 1 includes an OLED formed in each sub-pixel.

The OLED has an anode electrode and a cathode electrode, and includes an organic compound layer that is formed between the anode electrode and cathode electrode.

The organic compound layer includes a Hole Injection Layer (HIL), a Hole transport layer (HTL), an Emission Layer (EML), an Electron Transport Layer (ETL), and an Electron Injection Layer (EIL).

When a driving voltage is applied to the anode electrode and cathode electrode, a hole passing through the HTL and an electron passing through the ETL move to the EML to form an exciton, and thus the EML emits visible light.

In the OLED display device, a plurality of OLEDs including respective sub-pixels that are as illustrated in FIG. 1 are arranged in matrix type. The OLED display device supplies a scan pulse to selectively turn on thin film transistors PL and PT that are active elements, thereby selecting sub-pixels. Subsequently, the OLED display device controls the brightness of the selected sub-pixels with a supply voltage VDD, according to the grayscale levels of digital video data.

As another type of FPD device, LCD devices are thin and light and consume low power, and thus are being widely applied to computer monitors, notebook computers, portable terminals, and wall-mounted televisions.

The related art LCD device or OLED display device drives a panel at a fixed refresh rate (for example, 60 Hz or more), irrespective of the kinds of input images.

A timing controller, included in the related art LCD device or OLED display device, receives a video-related signal (hereinafter referred to as a video signal) from a graphic card (or called a system) and delivers the received signal to the panel as-is without changing a refresh rate (i.e., a frame driving frequency).

For example, when an LCD device or OLED display device with XGA-level resolution (for example, resolution of 1025×768 pixels) is driven at a frame driving frequency of 60 Hz, a vertical sync signal (Vsync) has a frequency of 60 Hz, a horizontal sync signal (Hsync) has a frequency of 48.4 KHz, and a pixel frequency is 65 MHz. Such frequencies are maintained as-is, regardless of various kinds of video signals.

As described above, since the related art LCD device or OLED display device always drives the panel at a fixed frame driving frequency (i.e., the refresh rate), constant consumption power by data transition occurs even when an input image is almost stationary as in documents.

In LCD devices or OLED display devices, as consumption power, there are static consumption power by a leakage current, and dynamic consumption power by transistors and capacitors.

Herein, data transition is associated with dynamic consumption power, which is divided into two kinds based on a transistor load and capacitor load. As a frame driving frequency becomes higher, consumption power increases.

For example, consumption power that is consumed by the sub-pixel of the OLED display device in FIG. 1 is expressed as Equation (1). Equation (1) shows that as an input frequency (i.e., a frame driving frequency) ($f_I$) becomes higher, consumption power ($P_D$) increases.

$$P_D=P_T+P_L=(C_{pd}\times V_{CC}^2\times f_I)+(C_L\times V_{CC}^2\times f_O) \quad (5)$$

where $P_D$ is a power-consumption capacitance, $f_I$ is an input frequency, $C_L$ is an external (load) capacitance, $f_O$ is an output signal frequency, and $V_{CC}$ is a supply voltage.

In the related art LCD device, when dynamically changing a frame driving frequency for decreasing consumption power, there is a high probability that an asymmetric component between an inter-frame positive data voltage and negative data voltage will is generated due to the polarity driving of the LCD device. Consequently, a flicker arises in the related art LCD device.

In the related art LCD device, when a positive data voltage VA in a portion (a) of FIG. 2 differs from a negative data voltage VB in a portion (b) of FIG. 2, a flicker arises. To provide an additional description, a data driver of the related art LCD device selectively uses positive data and negative data according to a polarity signal (POL), and when dynamically changing a refresh rate, there is much possibility that a flicker arises.

In the related art LCD device, even though not considering the above-described polarity driving, when a frame driving frequency decreases to less than a certain level (for example, to approximately 30 to 50 Hz), there is much possibility that a flicker arises, and thus, it is difficult to decrease the frame driving frequency to less than the certain level.

On the contrary, as described above, since the related art OLED display device has a fast response time by using self-emitting elements that self-emit light, there is small possibility that a flicker arises when a frame driving frequency decreases to a low level.

However, since the related art OLED display device displays an image at the same frame driving frequency even when receiving a fixed image where an input image is almost stationary as in documents, and particularly cannot differentiate a document and a moving image and differently change a frame driving frequency according to the document and moving image, the related art OLED display device unnecessarily consumes power when outputting a fixed image such as a document.

SUMMARY

Accordingly, the present invention is directed to a timing controller and an OLED display device using the same that substantially obviate one or more problems due to limitations and disadvantages of the related art.

An aspect of the present invention is to provide a timing controller and an OLED display device using the same, which changes a frame driving frequency for driving a panel according to an average brightness value and difference mean value between input frames.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a timing controller including: a reception unit receiving a plurality of video signals and a timing signal which are transferred from a system; an image signal generation unit realigning the video signals to generate a plurality of image signals; and a control signal generation unit analyzing the video signals to determine whether a current input image is a static image or a moving image, and generating a plurality of control signals according to the determined result, wherein the control signal generation unit generates a plurality of control signals which allow a panel to be driven at a change frame driving frequency lower than a reference frame driving frequency necessary for driving the moving image, when the current input image is determined as the static image.

In another aspect of the present invention, there is provided an OLED display device including: a timing controller; a panel including a plurality of OLEDs, and displaying an image; a gate driver controlling a plurality of gate lines which are formed in the panel, according to a gate control signal transferred from the timing controller; and a data driver respectively supplying a plurality of image signals, transferred from the timing controller, to a plurality of data lines which are formed in the panel according to a gate control signal transferred from the timing controller.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described with reference to the accompanying drawings.

Figure 1:
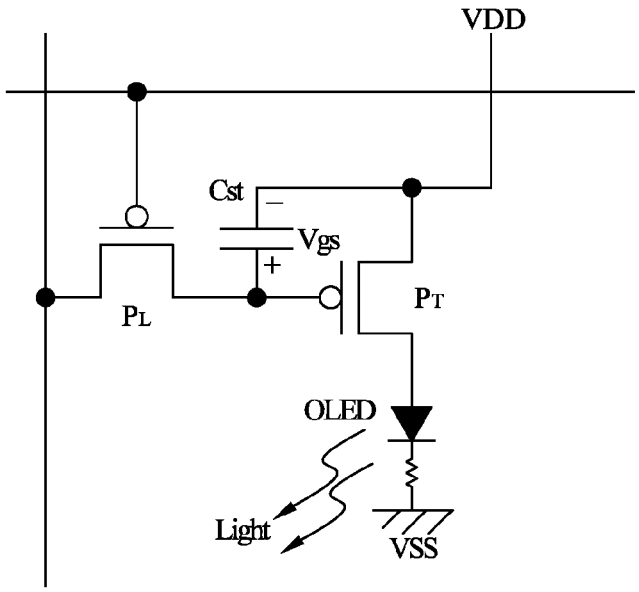
FIG. 1 is a circuit diagram for describing the light emitting principle of a related art OLED display device.
Figure 2:
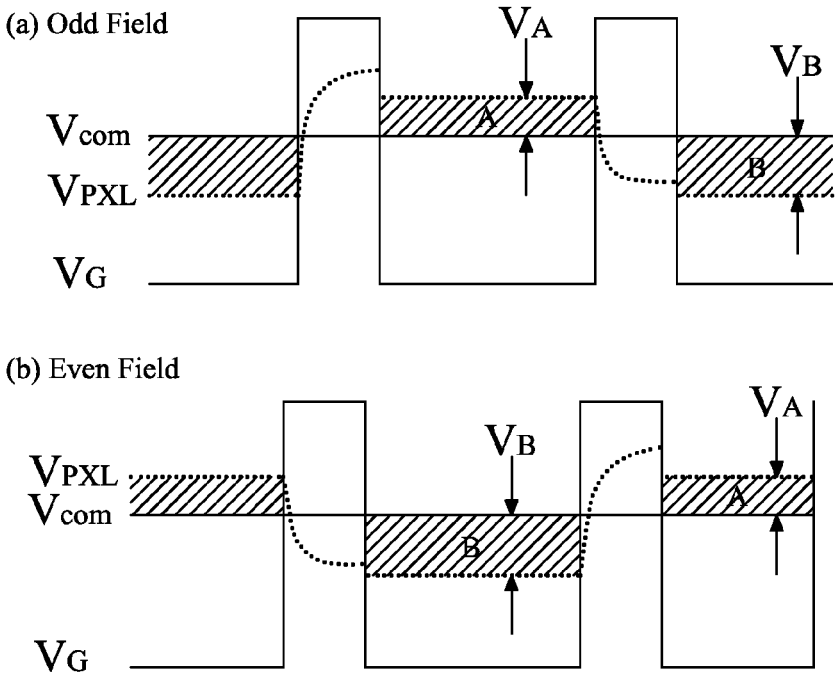
FIG. 2 is waveform diagrams for describing the cause of a flicker which arises in a related art LCD display device.
Figure 3:
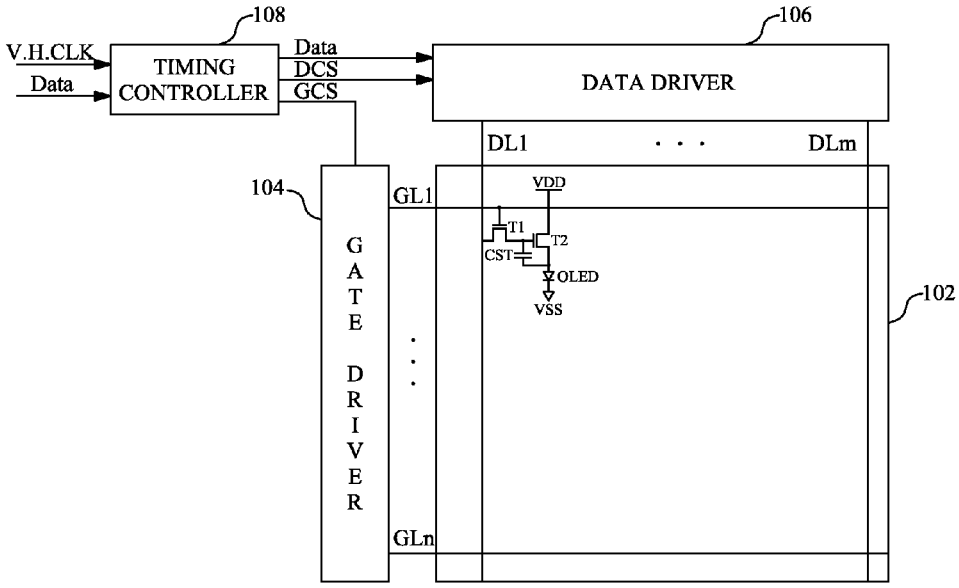
FIG. 3 is a block diagram illustrating an OLED display device according to an embodiment of the present invention.

FIG. 3 is a block diagram illustrating an OLED display device according to an embodiment of the present invention.

Referring to FIG. 3, an OLED display device according to an embodiment of the present invention includes a panel 102, a gate driver 104, a data driver 106, and a timing controller 108. Herein, the panel 102 includes a plurality of pixels that are arranged in a matrix type and driven by a scan pulse and a pixel signal, and displays an image. The gate driver 104 sequentially supplies the scan pulse to a plurality of gate lines GL1 to GLn that are formed in the panel 102, in response to a gate control signal GCS. The data driver 106 supplies the pixel signal to a plurality of data lines DL1 to DLm that are formed in the panel 102, in response to a data control signal DCS. The timing controller 108 outputs the gate control signal GCS for controlling the driving of the gate driver 104 and the data control signal DCS for controlling the driving of the data driver 106, and samples and realigns digital video data RGB (hereinafter referred to as a video signal) to output the realigned data. In addition, the OLED display device further includes a power supply (not shown) that supplies a power necessary for the elements.

The timing controller 108 outputs the gate control signal GCS for controlling the gate driver 104 and the data control signal DCS for controlling the data driver 106, with a vertical sync signal V, horizontal sync signal H, and clock signal CLK that are supplied from a system (not shown). Also, the timing controller 108 samples and realigns the video signal inputted from the system to supply an image signal to the data driver 106.

The timing controller 108 separately stores video signals of respective frames that are inputted from the system. The timing controller 108 determines whether a current input image is a static image or a moving image, by using an inter-frame differential mean and an average intensity of images. When the current input image is determined as the static image, the timing controller 108 generates a frequency control signal that allows a frame driving frequency to be reduced. Therefore, when a static image is outputted, the panel 102 is driven at a change frame driving frequency lower than a normal driving frequency, and thus, the consumption power of the panel 102 can decrease.

In a static image where the same image is outputted during a certain time as in documents or photographs, image sticking and the disconnection of an image do not occur even when the image is outputted at a low frame rate, namely, a low frame driving frequency. Due to this reason, the timing controller 108 determines whether the current input image is a static image or a moving image, by using the inter-frame differential mean and the average intensity of images. The timing controller 108 drives the panel 102 at a frame driving frequency suitable for the determined result, and thus can minimize data transition, thereby reducing consumption power for driving the panel 10.

A detailed configuration and function of the timing controller 108 will be described below with reference to FIGS. 4 and 5.

The gate driver 104 sequentially supplies the scan pulse (called a gate pulse or a gate-on signal) to the gate lines GL1 to GLn in response to the gate control signal GCS inputted from the timing controller 108, and thus, thin film transistors TFT included in a corresponding horizontal line of the panel 102 are turned on.

The data driver 106 converts image signals RGB into analog pixel signals (called data signals or data voltages) corresponding to respective grayscale values of the image signals RGB, and respectively supplies the pixel signals to the data lines DL1 to DLm of the panel 102, in response to the data control signal DCS inputted from the timing controller 108.

The panel 102 includes a plurality of pixels that are respectively formed at a plurality of areas where the gate lines GL1 to GLn and data lines DL1 to DLm intersect perpendicularly. As illustrated in FIG. 3, one gate line, one data line, a high potential line for receiving a high potential supply voltage VDD, and a low potential line for receiving a low potential supply voltage VSS may be formed in each of the pixels. Also, an OLED is connected between the high potential line and low potential line of each pixel.

Each pixel may include a switching transistor T1 that is electrically connected to a corresponding gate line, data line, and first node. Each pixel may include a driving transistor T2 that is electrically connected to the first node and a corresponding high potential line and second node. Each pixel may include a storage capacitor Cst that is formed to be electrically connected between the first node and high potential line.

In the OLED display device, the timing controller 108 receives the synch signals V and H, the clock signal CLK, a data enable signal DE, and the video signal Data, etc. from the external system through an interface (not shown).

Herein, the video signal inputted from the system may be supplied to the timing controller 108 by a Low Voltage Differential Signal (LVDS) scheme.

Figure 4:
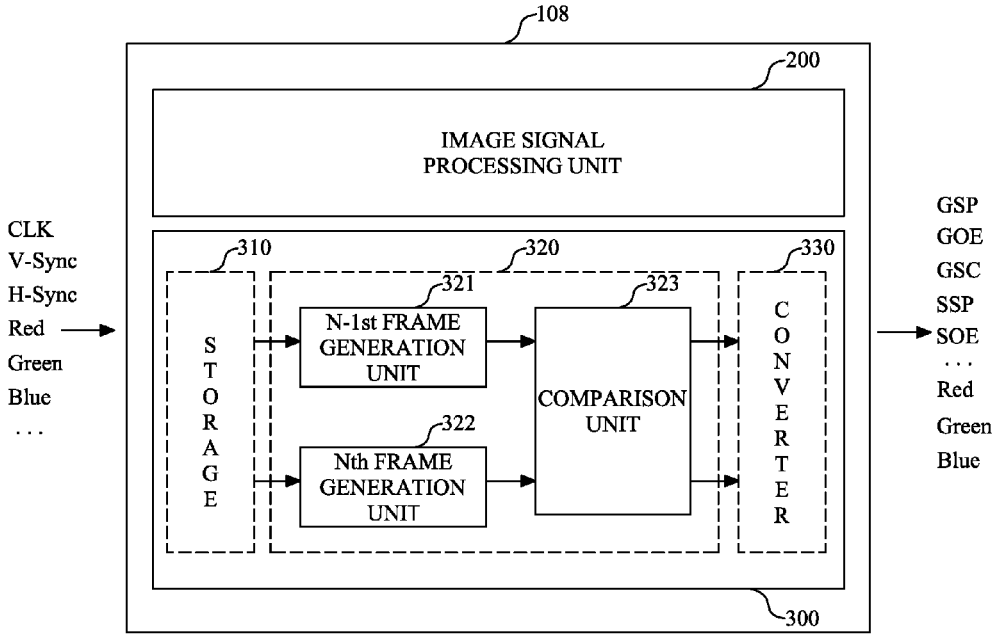
FIG. 4 is a block diagram illustrating a timing controller according to an embodiment of the present invention.

FIG. 4 is a block diagram illustrating a timing controller according to an embodiment of the present invention. FIG. 5 is graphs for describing a method where a timing controller according to an embodiment of the present invention determines a static image and a moving image.

The timing controller 108 fundamentally realigns the video signal supplied from the system to deliver an image signal to the data driver 106. The timing controller 108 generates the gate control signal GCS and data control signal DCS with the clock signal CLK, horizontal synch signal Hsync, vertical sync signal Vsync, and data enable signal DE that are supplied from the system, and respectively delivers the gate control signal GCS and data control signal DCS to the gate driver 104 and data driver 106. Herein, the clock signal CLK, horizontal synch signal Hsync, vertical sync signal Vsync are referred to as a timing signal.

Herein, the vertical sync signal Vsync and horizontal sync signal Hsync are signals for synchronizing the video signals RGB. The vertical sync single Vsync is a signal for differentiating frames, and inputted at one-frame intervals. The horizontal sync signal Hsync is a signal for differentiating lines in one frame, and inputted at one-line intervals.

The data enable signal DE is a signal for displaying a section having effective data, and indicates a time for supplying data to each pixel.

The horizontal synch signal Hsync, vertical sync signal Vsync, and data enable signal DE are activated or deactivated according to the clock signal CLK.

The timing controller 108 includes a reception unit (not shown) an image signal processing unit 200, a control signal generation unit 300, and a transmission unit (not shown). The image signal processing unit 200 realigns the video signals of the signals inputted from the reception unit to output respective image signals. The control signal generation unit 300 generates various control signals for controlling the gate driver 104 and data driver 106 with the signals inputted from the reception unit, separately stores input video signals of respective frames, and then determines whether a current input image is a static image or a moving image by using the inter-frame differential mean and the average intensity of images. When the current input image is determined as the static image, the timing controller 108 generates the control signals that allow the panel 102 to be driven at a low frame driving frequency. The transmission unit transfers the control signals, which is intended to be transferred to the data driver 106 among the control signals received from the control signal generation unit 300, and the image signals generated by the image signal processing unit to the data driver 106, and transfers the control signals, which is intended to be transferred to the gate driver 104 among the control signals received from the control signal generation unit 300, to the gate driver 104.

The reception unit (not shown) receives the various signals (for example, the clock signal CLK, horizontal sync signal Hsync, vertical sync signal Vsync, data enable signal DE, etc.) and video signals from the system.

The image signal processing unit 200 realigns the video signals received through the reception unit to output respective image signals.

The transmission unit (not shown) transfers the image signals generated by the image signal processing unit 200 and some of the various signals generated by the control signal generation unit 300 to the data driver 106, and transfers the other of the various signals to the gate driver 106.

The control signal generation unit 300 generates the gate control signal GCS and data control signal DCS with the various signals received through the reception unit. Particularly, the control signal generation unit 300 analyzes input image signals by frame to determine whether to change a frame driving frequency, and generates the control signals according to a selected frame driving frequency.

For this end, as illustrated in FIG. 4, the control signal generation unit 300 may include a frame storage 310, a frame comparator 320, and a converter 330.

The frame storage 310 stores the video signals received through the reception unit. Specifically, the timing controller 108 compares an Nth frame and an N−1st frame to determine whether the Nth frame is a static image or a moving image, for which the frame storage 310 stores the video signals received through the reception unit.

The frame comparator 320 substantially compares the Nth frame and the N−1st frame to determine whether an image of the Nth frame is a static image or a moving image. For this end, as illustrated in FIG. 4, the frame comparator 320 includes an N−1st frame generation unit 321, an Nth frame generation unit 322, and a comparison unit 323.

The N−1st frame generation unit 321 and Nth frame generation unit 322 separately extract the video signals of respective frames that are stored in the frame storage 310, and temporarily stores the extracted signals.

The comparison unit 323 compares the Nth frame and the N−1st frame to determine whether the current input image is a static image or a moving image. In this case, the comparison unit 323 may use an inter-frame differential image or an inter-frame average brightness value by using a frame memory when analyzing an input image, or use a line differential image or line average brightness value between adjacent frames by using a line memory when analyzing an input image.

For example, when an input image is a static image, particularly, when the input image is a static image such as a document, the image has a high average brightness value because a background image generally is white. In this case, a text operation is mainly performed, and thus, the change (i.e., differential mean) in total pixels is small.

On the contrary, when the input image is a moving image, the change in total pixels is large (for example, about 24 to 30 fps) because the image generally is dark in average brightness.

Figure 5:
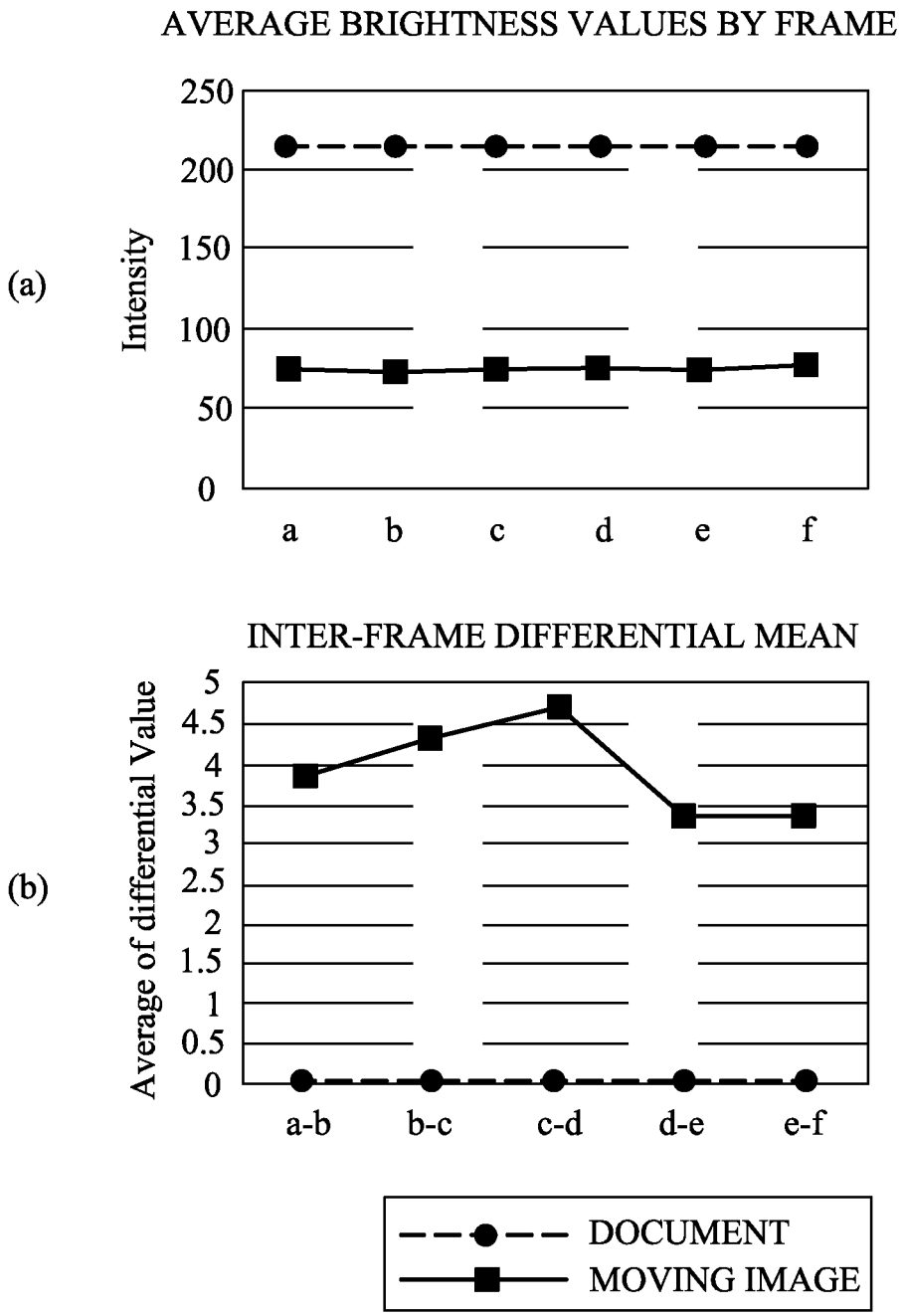
FIG. 5 is graphs for describing a method where a timing controller according to an embodiment of the present invention determines a static image and a moving image.

Comparing average brightness values by frame, as shown in a portion (a) of FIG. 5, a static image (which is indicated by "-●-" in FIG. 5) such as a document shows a high average brightness value, and a moving image (which is indicated by "-■-" in FIG. 5) shows a low average brightness value.

Comparing inter-frame differential mean values, as shown in a portion (b) of FIG. 5, it can be seen that a moving image (which is indicated by "-■-" in FIG. 5) has the greater change in total pixels than a static image (which is indicated by "-●-" in FIG. 5).

As shown in the graphs of the portions (a) and (b) of FIG. 5, the comparison unit 323 compares and analyzes average brightness values by frame and inter-frame differential mean values to determine whether a current input image is a static image or a moving image.

When the determined result shows that the input image is the moving image, the comparison unit 322 transfers a frequency control signal, which allows the panel 102 to be driven at a reference driving frequency, to the converter 330.

When the OLED display device according to an embodiment of the present invention is driven at a maximum frame driving frequency (i.e., maximum refresh rate) of 120 Hz, the frequency control signal is transferred to the converter 330 such that the control signals are generated according to the reference frame driving frequency used as the maximum frame driving frequency.

However, when the panel 102 is being already driven at the reference frame driving frequency, the transfer of a separate frequency control signal is not required.

Therefore, the converter 330 generates the control signals and respectively transfers the control signals to the gate driver 104 and data driver 106, according to the reference frame driving frequency.

However, when the determined result shows that the input image is the static image, the comparison unit 323 transfers a frequency control signal, which allows the panel 102 to be driven at a predetermined change frame driving frequency, to the converter 330.

As described above, when the OLED display device is driven at a reference frame driving frequency of 120 Hz, the change frame driving frequency may be one of 60 Hz, and 45 Hz or less. Therefore, the comparison unit 323 transfers a frequency control signal, which allows the converter 330 to generate various control signals according to the predetermined change frame driving frequency, to the converter 330. Herein, the change frame driving frequency may be within a range from 60 Hz to 30 Hz.

In this case, the change frame driving frequency may be set as one, but set as two or more. That is, the comparison unit 323 compares frames to determine whether to drive the panel 102 at the lowest change frame driving frequency or an intermediate change frame driving frequency in consideration of the degree or change rate of a static image included in the input image, and transfers a frequency control signal based on a corresponding change frame driving frequency to the converter 330.

The comparison unit 323 may calculate an average pixel change value and an average brightness value of the Nth frame by using a differential mean between the N−1st frame and Nth frame. In this case, as inter-frame pixel change becomes smaller and the average value of the Nth frame becomes greater, the comparison unit 323 may select a low frame driving frequency and transfer a frequency control signal based on the selected frequency to the converter 330. However, as described above, the comparison unit 323 may determine whether the input image is a static image by using a line differential image or line average brightness value between adjacent frames, and then transfer a frequency control signal based on the determined result to the converter 330.

To provide an additional description, the comparison unit 323 may analyze an input image to reset a frame driving frequency for driving the panel 102, and particularly, when a static image such as a document is determined as being inputted, the converter 330 may change the gate control signal GCS to be transferred to the gate driver 104 or the data control signal DCS to be transferred to the data driver 106 such that the panel 102 is driven at a low change frame driving frequency. At this point, when an image signal outputted from the image signal processing unit 200 is required to be changed, the comparison unit 323 may transfer the frequency control signal to the image signal processing unit 200.

The converter 330 controls timing with the vertical sync signal Vsync, horizontal sync signal Hsync, and data enable signal DE to generate respective control signals to be transferred to the gate driver 104 and data driver 106 and respectively transfer the control signals to the gate driver 104 and data driver 106, according to the frequency control signal inputted from the comparison unit 323.

Therefore, the panel 102 receives image signals from the data driver 106 to display an image according to control signals that are respectively supplied from the gate driver 104 and data driver 106. In this case, when the panel 102 is driven at the reference frame driving frequency, since a frame driving frequency of 120 Hz is used, 120 screens are outputted per second. Alternatively, when the panel 102 is driven at the change frame driving frequency, since a driving frequency of 60 Hz or 45 Hz is used, 60 or 45 screens are outputted per second.

Furthermore, since OLEDs have a slow response time, a flicker does not occur even when the panel 102 is driven at a frame driving frequency of 45 Hz or less, and moreover, the consumption power of the panel 102 can decrease in proportion to the reduction in the frame driving frequency.

The converter 330 generates the following control signals according to the determined result of the comparison unit 323.

The gate control signal GCS includes a gate start pulse (GSP), a gate output enable signal (GOE), and a gate shift clock (GSC). The data control signal DCS includes a source output enable signal (SOE), a source sampling clock (SSC), a polarity reversal signal (POL), and a source start pulse (SSP). In addition, the converter 330 may convert various control signals that are required for driving the panel 102 at the chance frame driving frequency.

The OLED display device according to the embodiments of the present invention dynamically controls the frame driving frequency to be lowered according to an input image, based on the maximum refresh rate that is used to drive the panel, and thus can decrease data transition, thereby reducing consumption power.

That is, even when the OLED display device according to an embodiment of the present invention is driven at a low change frame driving frequency in realizing a static image, image sticking or the disconnection of an image do not occur. Accordingly, the timing controller 108 determines whether a current input image is a static image or a moving image by using an inter-frame differential mean and an average intensity of images. The timing controller 108 drives the panel 102 at a frame driving frequency suitable for the determined result, and thus can minimize data transition.

An operation has been described above where the panel 102 is driven at the change frame driving frequency when the panel 102 is being driven at the reference frame driving frequency, but its reverse operation may also be performed by applying the above-described method.

Specifically, while the panel 102 is being driven at the change frame driving frequency, when an input image is determined as a moving image instead of a static image, the timing controller 108 may generate control signals that allow the panel 102 to be driven at the reference frame driving frequency, and respectively transfer the control signals to the gate driver 104 and data driver 106.

In the above-described embodiment, the timing controller 108 directly analyzes a frame and changes a frame driving frequency according to the analyzed result, but the present invention is not limited thereto. As another example, the timing controller 108 may change the frame driving frequency according to the frequency control signal transferred from the system.

For example, when a user performs a document operation with a device such as a notebook computer, an OLED display device that is built in the notebook computer determines whether a current input image signal corresponds to a document through the above-described comparison and analysis, and drives a panel at a change frame driving frequency lower than a reference frame frequency.

In another embodiment of the present invention, an OLED display device may include an input terminal that is directly connected to a notebook computer or timing controller. When a user selects a document operation mode with the input terminal, a document operation mode selection signal inputted through the input terminal may be inputted to a timing controller, and the timing controller may output image signals and various control signals that allow a panel to be driven at a change frame driving frequency lower than a reference frame driving frequency.

As described above, the OLED display device according to the embodiments of the present invention changes the frame driving frequency for driving the panel according to the average brightness value and differential mean value between input frames, and changes the frame driving frequency to lower than the reference frame driving frequency, thus reducing the consumption power of the panel.

The OLED display device according to the embodiments of the present invention reduces the consumption power, and thus can extend the operable time of mobile devices such as portable phones.

The OLED display device according to the embodiments of the present invention dynamically controls the frame driving frequency to be lowered according to an input image, based on the maximum refresh rate that is used to drive the panel, and thus can decrease data transition, thereby reducing consumption power.

The OLED display device according to the embodiments of the present invention additionally lowers the frame driving frequency when an input image is bright and has a static motion, and thus can minimize stress given to each OLED, thereby extending the service life of the panel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A timing controller, comprising:

a reception unit configured to receive a plurality of video signals and a timing signal transferred from a system;

an image signal generation unit configured to realign the video signals to generate a plurality of image signals; and a control signal generation unit configured to:

analyze the video signals to determine whether a current input image is a static image or a moving image;

generate a plurality of control signals according to the determined result;

generate a plurality of control signals which allow a panel to be driven at a change frame driving frequency lower than a reference frame driving frequency necessary for driving the moving image when the current input image is determined as the static image; and determine whether the input image is the static image by using a differential mean and average brightness values between frames, wherein the control signal generation unit further comprises a frame comparator configured to analyze the video signals for each frame or each line of adjacent frames to determine the current input image is the static image, wherein the frame comparator comprises:

an N−1 st frame generation unit configured to store an N−1 st frame for the video signals; and an Nth frame generation unit configured to store an Nth frame for the video signals wherein control signals are generated according to the change frame driving frequency when the current input image is determined as the static image.

2. The timing controller according to claim 1, wherein the panel comprises a plurality of Organic Light Emitting Diodes (OLEDs).

3. The timing controller according to claim 1, wherein a gate driver and data driver connected to the panel are respectively controlled according to the control singles generated by the control signal generation unit.

4. The timing controller according to claim 1, wherein the control signal generation unit compares the video signals by frame or compares and analyzes lines between adjacent frames to determine whether the current input image is the static image.

5. The timing controller according to claim 1, wherein when a document operation mode selection signal is received by the reception unit, the control signal generation unit generates the control signals which allow the panel to be driven at the change frame driving frequency.

6. The timing controller according to claim 1, wherein the change frame driving frequency is set as at least one or more Hz.

7. The timing controller according to claim 1, wherein the control signal generation unit further comprises:

a storage configured to store the video signals received by the reception unit;

and a converter configured to generate the control signals which allow the panel to be driven at the change frame driving frequency, when the current input image is determined as the static image by the frame comparator.

8. The timing controller according to claim 7, wherein the frame comparator further comprises:

a comparison unit configured to:

determine whether the input image is the static image by using the differential mean and average brightness values between frames which are respectively transferred from the N−1st frame generation unit and Nth frame generation unit; and transfer the frequency control signal, which allows the control signals to be generated according to the change frame driving frequency, to the converter when the current input image is determined as the static image.

9. The timing controller according to claim 1, wherein the change frame driving frequency is within a range from 60 Hz to 30 Hz.

10. An Organic Light Emitting Diode (OLED) display device, comprising:

a timing controller of claim 1;

a panel comprising a plurality of OLEDs, and configured to display an image;

a gate driver configured to control a plurality of gate according to a gate control signal transferred from the timing controller, the gate lines being formed in the panel; and a data driver configured to respectively supply a plurality of image signals, transferred from the timing controller, to a plurality of data lines according to a gate data control signal transferred from the timing controller, the data lines being formed in the panel.

* * * * *